US005722791A

United States Patent [19]

Dallmer

[11] Patent Number: 5,722,791

[45] Date of Patent: Mar. 3, 1998

[54] ROOF DRAIN FITTING

[75] Inventor: Johannes Dallmer, Arnsberg, Germany

[73] Assignee: Dallmer GmbH & Co., Arnsberg, Germany

[21] Appl. No.: 613,174

[22] Filed: Mar. 8, 1996

[30] Foreign Application Priority Data

Mar. 25, 1995 [DE] Germany ..... 195 10 955.4

[51] Int. Cl.[6] ..... E03F 1/00

[52] U.S. Cl. ..... 405/52; 210/163; 405/36

[58] Field of Search ..... 405/52, 303, 36; 210/163–165

[56] References Cited

U.S. PATENT DOCUMENTS

| | | | |
|---|---|---|---|
| 1,538,924 | 5/1925 | Boosey | 210/163 |
| 2,672,205 | 3/1954 | McDonald | 210/163 X |
| 3,529,723 | 9/1970 | Hagedorn | 210/163 |
| 4,505,814 | 3/1985 | Marshall | 404/26 X |

FOREIGN PATENT DOCUMENTS

| | | |
|---|---|---|
| 7331141.8 | 8/1973 | Germany . |
| 7537020 | 3/1976 | Germany . |
| 3109345C2 | 7/1985 | Germany . |
| 8807227.8 | 4/1988 | Germany . |
| 8812369.3 | 9/1988 | Germany . |
| 0457012A1 | 8/1991 | Germany . |
| 4131772A1 | 1/1993 | Germany . |
| 57012A1 | 10/1994 | Germany . |

*Primary Examiner*—Dennis L. Taylor
*Attorney, Agent, or Firm*—Collard & Roe, P.C.

[57] ABSTRACT

A roof drain fitting having a box-like bottom part screwed to the supporting roof over a break-through which extends through the roof. A top part having a down pipe and a collar as one unit is slipped over the bottom part. The top part is vertically adjustable to the height of a heat-insulating layer located on the roof. The bottom part and the top part are provided with heat insulation and are secured to each other with adjustable securing devices.

12 Claims, 9 Drawing Sheets

ROOF DRAIN FITTING

BACKGROUND OF THE INVENTION

1. Field of the Invention

The present invention relates to a roof drain fitting. More particularly, it relates to a roof drain fitting having a clamping ring for securing flashing to a supporting collar.

2. The Prior Art

Roof drain fittings are known from German Patent DE-P 31 09 345, where a collar is molded onto the top of a pot. At the bottom of the pot, there is attached a short down pipe. The collar supports flashing arranged on the surface of the roof. Around the collar, the flashing is secured by a clamping ring. During the installation, the pot is integrally cast in a concrete roof, requiring the collar to be initially properly positioned with respect to the height and slope of the flashing.

SUMMARY OF THE INVENTION

It is therefore an object of the present invention to overcome the drawbacks of the prior art and to provide a roof drain fitting which can be simply installed on any type of roof.

It is a further object of the present invention to provide a roof drain fitting which supports the surrounding flashing with a clamping ring.

These and other related objects are achieved according to the invention by a roof drain fitting having a clamping ring for securing flashing to a supporting collar comprising a box-shaped bottom part including a bottom plate with a circular recess formed therein and planar side walls connected to the bottom plates, each having an exterior surface. A molded top part includes a down pipe, a pot adjoining the down pipe, a collar extending outwardly from above the pot, and four planar walls extending downwardly from the collar. Securing elements are provided for adjustably securing the top part to the bottom part in different vertical positions. The down pipe extends through the circular recess to concentrically orient the top part with the bottom part with the four planar walls disposed adjacent the exterior surfaces of the side walls. The top part is vertically adjusted by the securing elements to maintain the top part in a particular vertical position. The securing elements are arresting elements for adjustably securing the side walls to the four planar walls. During the installation of a roof drain fitting according to the invention, the box-like bottom part is attached and screwed to the supporting roof construction first, over a breakthrough in the roof. No integral casting in concrete is required. The roof drain fitting has a cylindrical heat-insulating layer surrounding the down pipe and pot and a heat-insulating portion is molded to an inside of the side walls of the bottom part. The length of the walls is dimensioned in such a way that a wide range of insulation heights can be accommodated. A roof drain fitting according to the invention can be used both with solid roofs and supporting sheet metal construction.

The roof drain fitting has a ring formed on the top part attached to the collar. The ring includes threaded holes for receiving clamping ring screws. An upper indentation is formed in each corner where the adjacent planar walls meet. Each indentation accommodates an arresting element, and a lower indentation corresponding to each upper indentation is formed in the bottom part. The arresting elements comprise a leaf spring with a pin connected to the top part and a row of holes formed in the planar side walls for receiving the pin. The planar side walls include an opening serving as an emergency water drain prior to installation of the top part.

According to an alternate embodiment of the invention, the vertical position of the top part with respect to the bottom part is adjusted by plaster screws corresponding to the thickness of the heat insulation layer of the supporting roof. A stepless adjustment is possible in this connection with a powered screwing device. The pressure during tight clamping of the sealing web is absorbed by the profiled support ring, and deformation of the plastic is avoided.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
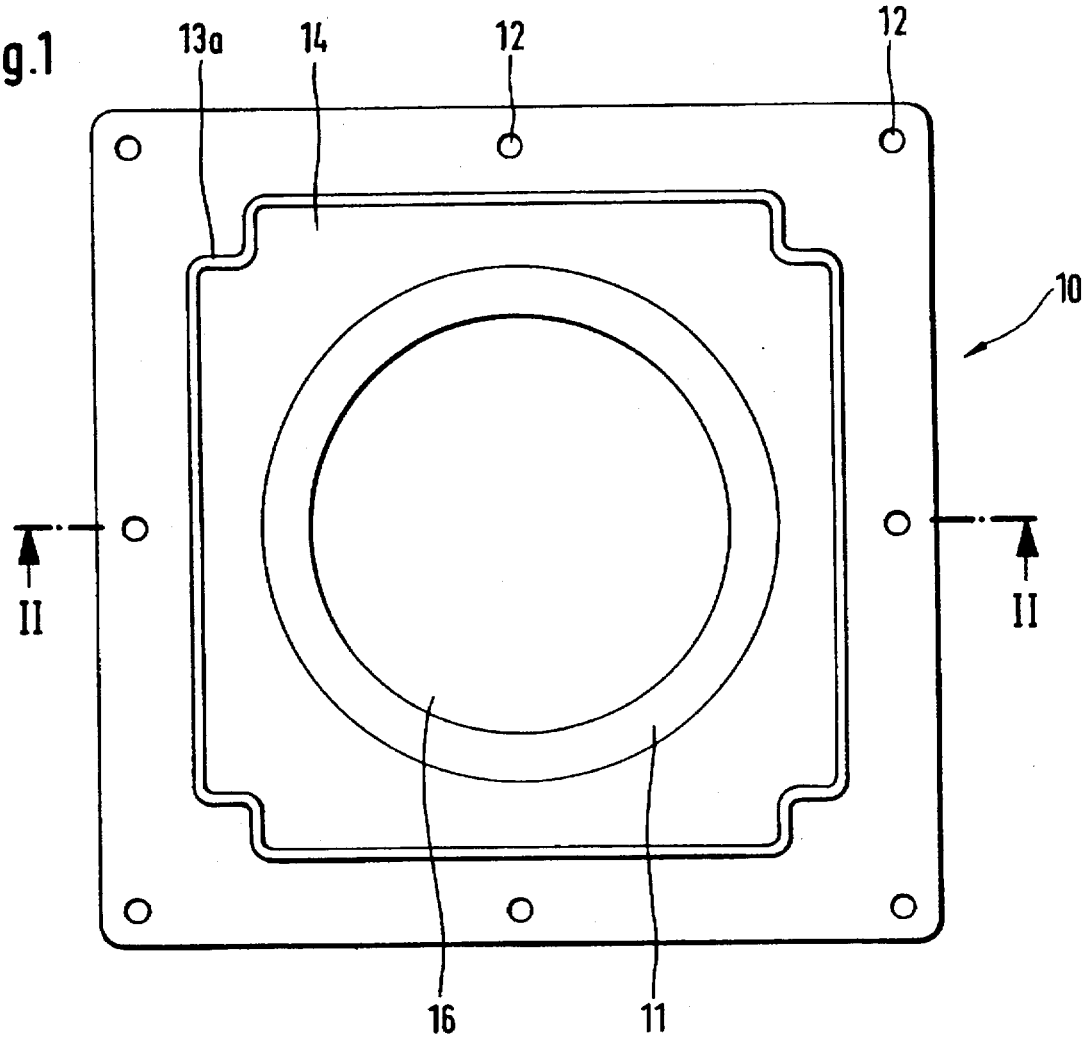
FIG. 1 is a top plan view of a box-like bottom part of a roof drain fitting according to the invention.
Figure 2:
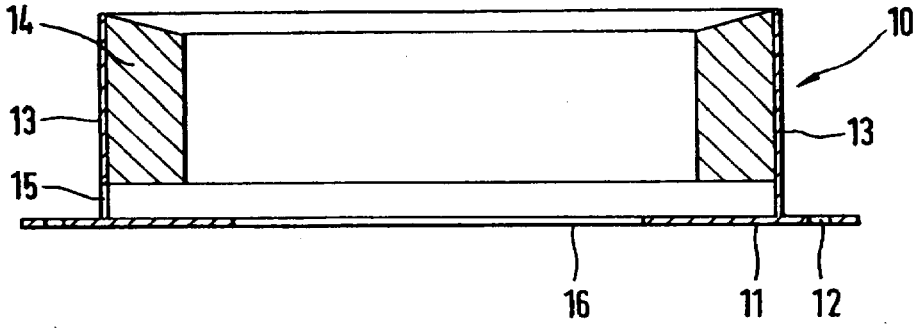
FIG. 2 is a cross-sectional view thereof taken along the line II—II from FIG. 1.

Referring now in detail to the drawings and, in particular FIGS. 1 and 2, there is shown a bottom part 10 of a roof drain fitting according to an embodiment of the invention which is box-shaped and square when viewed from the top. Bottom part 10 includes a bottom 11, four walls 13 and a circular recess 16, for receiving a down pipe, which is formed centrally in bottom 11. Indentations 13*a* for receiving arresting elements are formed at the corners where walls 13 meet. During installation, bottom part 10 is placed on a supporting construction of a roof and secured there with screws passing through screw holes 12 formed within bottom 11. Along the height of indentations 13*a*, there is a row of holes 17 within the walls 13, shown in FIGS. 5 and 6, for engaging the arresting elements.

Figure 3:
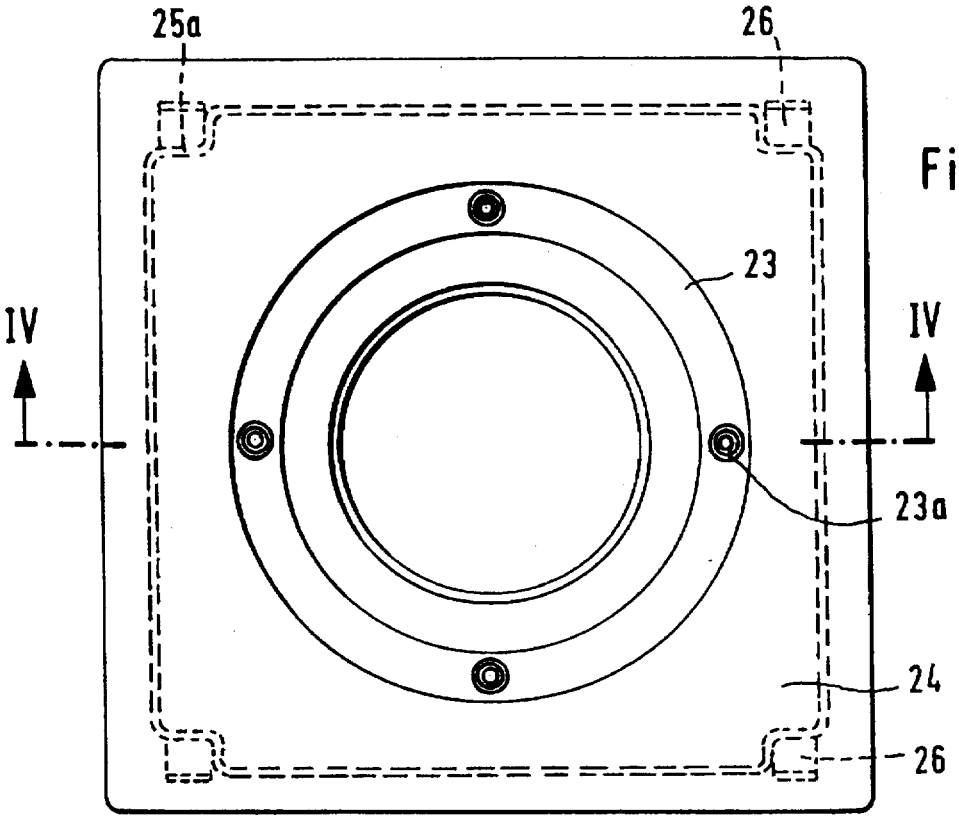
FIG. 3 is a top plan view of a top inlet portion of the roof drain fitting.
Figure 4:
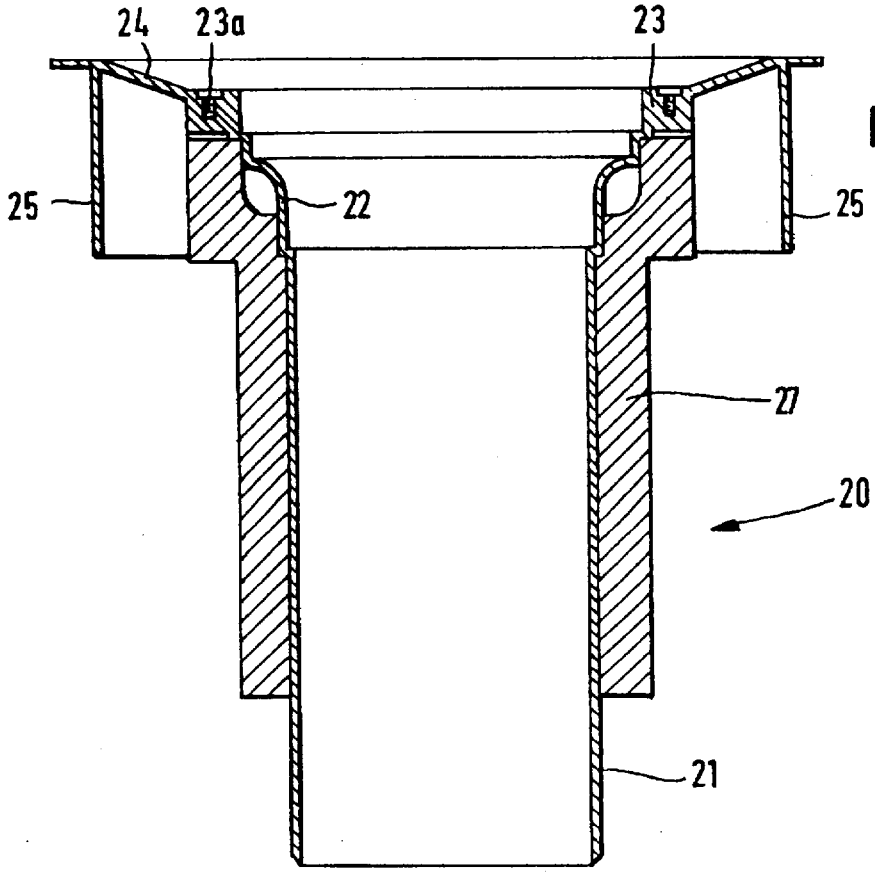
FIG. 4 is a cross-sectional view taken along the line IV—IV from FIG. 3.

FIGS. 3 and 4 show a top part or an inlet part 20 which is an integrally-molded part made of plastic, consisting of a down pipe 21, a pot-like pipe widening 22 adjoining a ring 23, which is followed by a collar 24. When viewed from the top, collar 24 is square. Four planar walls 25 extend downwardly from collar 24 radially spaced from pot 22 and ring 23. Walls 25 have indentations 25*a* at their corners. Each corner has an arresting element 26 in the form of a leaf spring. A pin is secured to the lower end of the leaf spring, for engaging one of the holes within row 17, as shown in FIGS. 5 and 6.

The majority of down pipe 21 and pipe widening 22 is surrounded by a cylindrical heat-insulating layer 27. Threaded sleeves 23*a* are formed within ring 23 for receiving screws to mount a clamping ring. Bottom part 10, shown in FIGS. 1 and 2, also has molded parts 14 for heat insulation which are mounted inside of box walls 13. Molded parts 14 have a cylindrical shape on the inside, for accommodating heat-insulating layer 27 of top part 20. The insulating layers provided on both top part 20 and bottom part 10 assures adequate insulation at any altitude.

Figure 5:
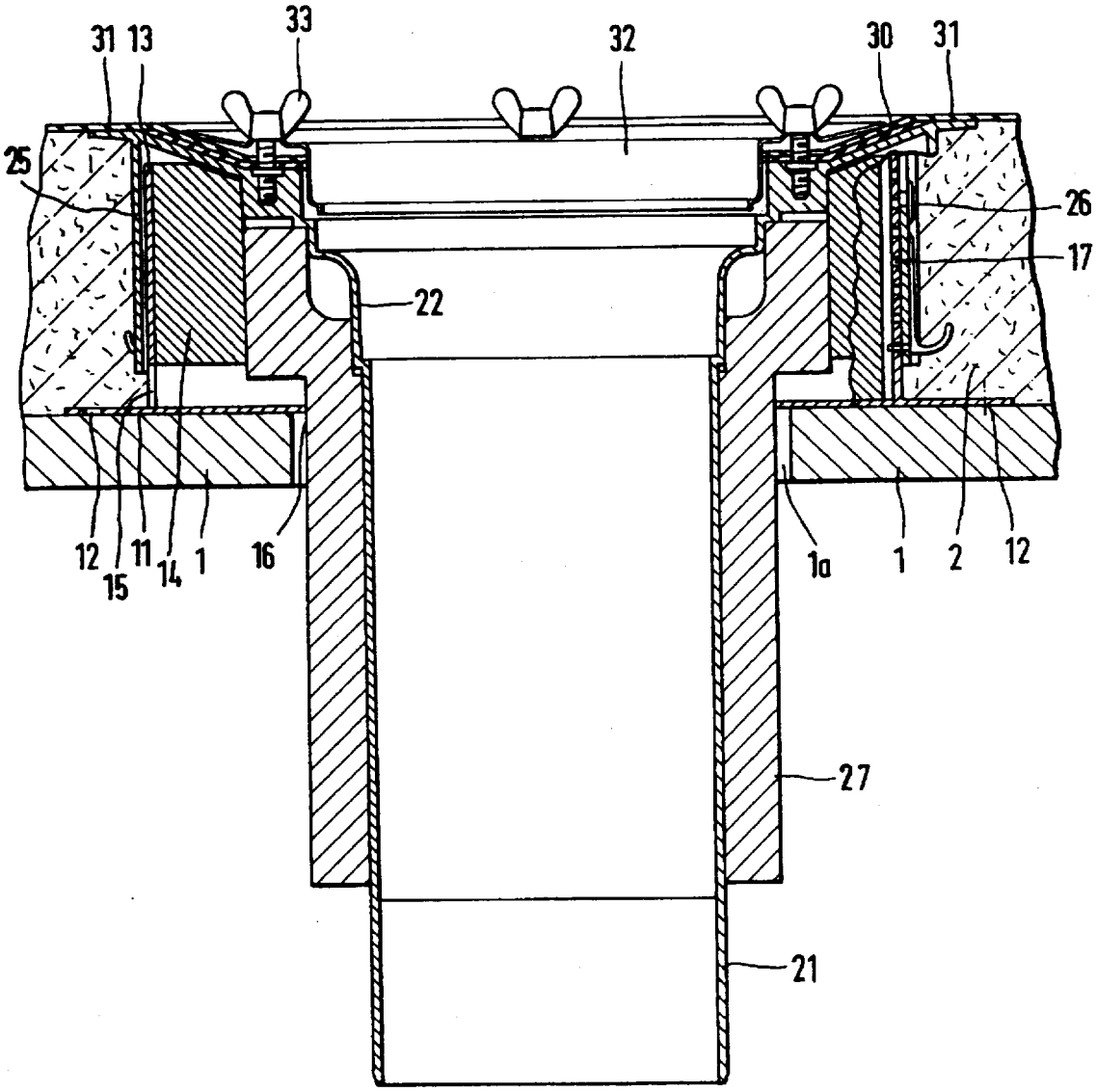
FIG. 5 is a longitudinal cross-sectional view through a completely installed roof drain fitting with a minimum vertical adjustment of the orifice, taken along the line V—V from FIG. 7.
Figure 6:
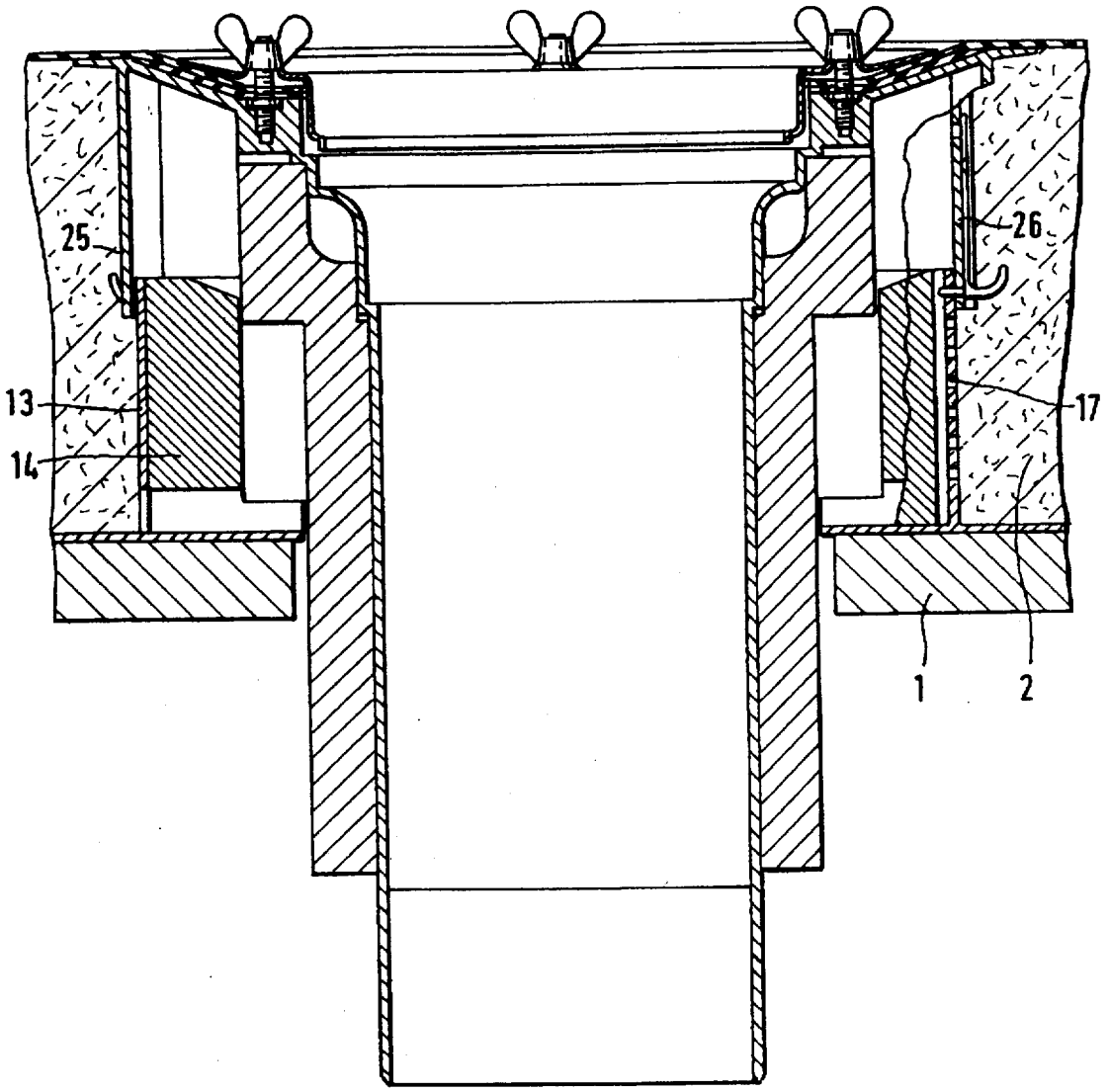
FIG. 6 is another longitudinal cross-sectional view with a maximum vertical adjustment.
Figure 7:
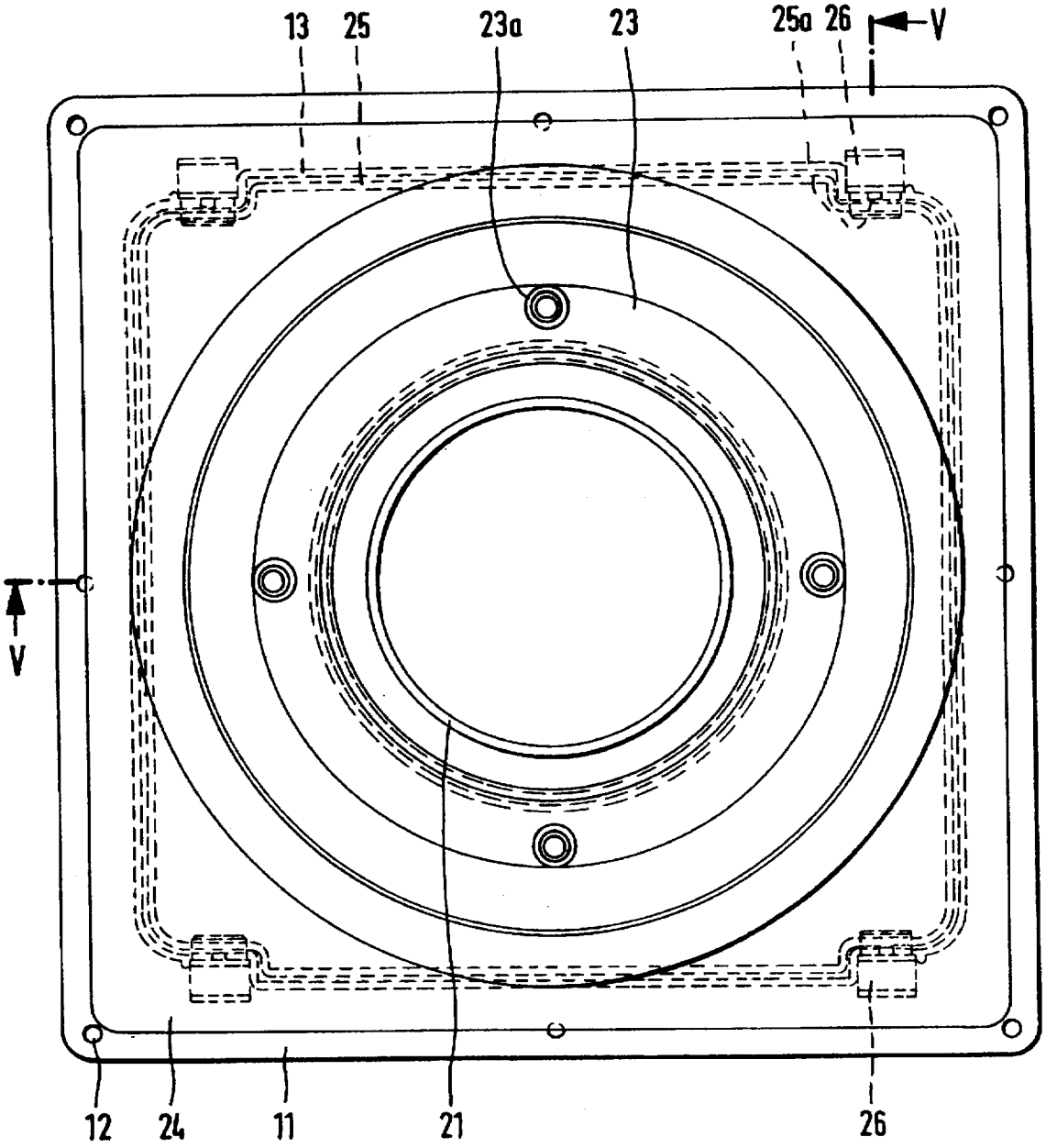
FIG. 7 is a top plan view of a complete roof drain fitting.

A completely installed roof drain fitting according to the invention is shown in FIGS. 5 and 7. Bottom 11 of bottom part 10 is placed on a supporting roof 1, over a circular break-through 1*a* extending through the roof. Bottom part 11 is secured to the supporting roof by screws which extend through screw holes 12. An opening 15 is formed in the bottom of one wall 13. Opening 15 forms an emergency water drain through which water can flow off into the drain if the top part is not yet mounted in place.

Top part 20 is slipped over bottom part 10 with down pipe 21 and heat-insulating layer 27 being coaxially received within circular recess 16 of bottom 11. When top part 20 is installed over bottom part 10, walls 25 of top part 20 are positioned on the outside of box walls 13 of bottom part 10. Top part 20 is vertically height adjustable to accommodate varying thicknesses of a heat-insulating layer 2 placed on roof 1. Top part 20 is maintained at a particular vertical position by arresting elements 26 located in the corners. Flashing 31 covers heat-insulating layer 2 and is placed on collar 24, sandwiching a sealing ring 30 therebetween. Flashing 31 is secured by a clamping ring 32. Clamping screws 33 are screwed into threaded sleeves 23*a* to bolt clamping ring 32 in place over flashing 31.

Since insulation layer 2 is relatively thin in FIG. 5, collar 24 is vertically adjusted to its lowest point where it abuts molded part 14. In contrast, FIG. 6 shows a relatively thick insulation layer 2. Collar 24 is vertically adjusted to its highest point where arresting elements 26 engage the upper hole within row 17. The positioning of holes within row 17 allows a range of vertical adjustment between the position of FIG. 5 and the position of FIG. 6. As can be appreciated, the vertical adjustment of top part 20 assures proper alignment and slope with flashing 31 regardless of the position of bottom part 10.

Figure 8:
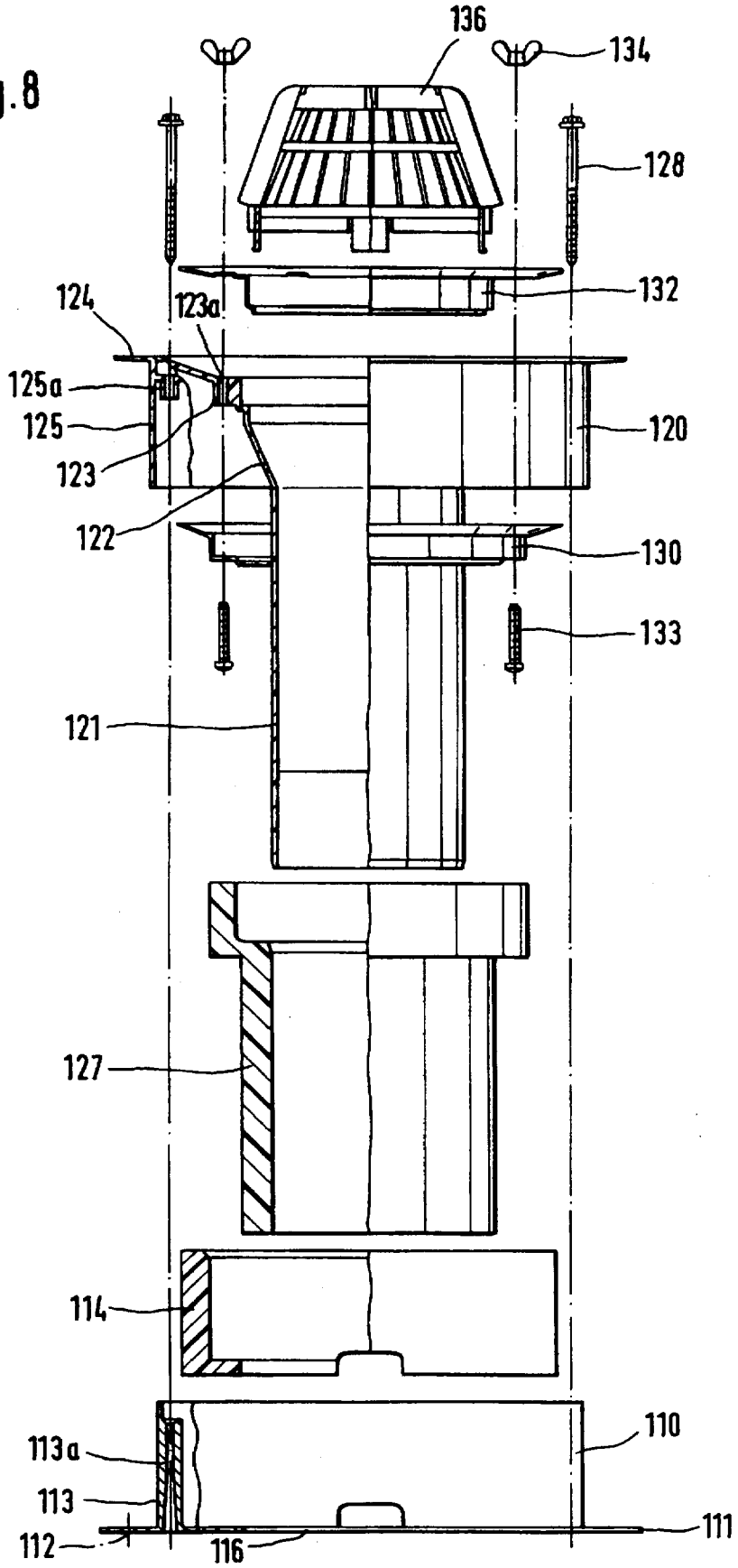
FIG. 8 is an exploded view of an alternate embodiment of a roof drain fitting according to the present invention.

An alternate embodiment of the roof drain fitting according to the invention is described with reference to FIG. 8. Bottom part 110 is box-shaped with a bottom 111 and four walls 113. Bottom part 110 appears square when viewed from the top. A circular recess 116 for receiving a down pipe is formed in the center of the bottom. Reinforcements 113*a* for receiving plaster screws are formed in the corners where walls 113 meet. During installation, bottom part 110 is placed on a supporting structure of a roof and fastened with screws that extend through screw holes 112 of bottom 111.

Figure 11:
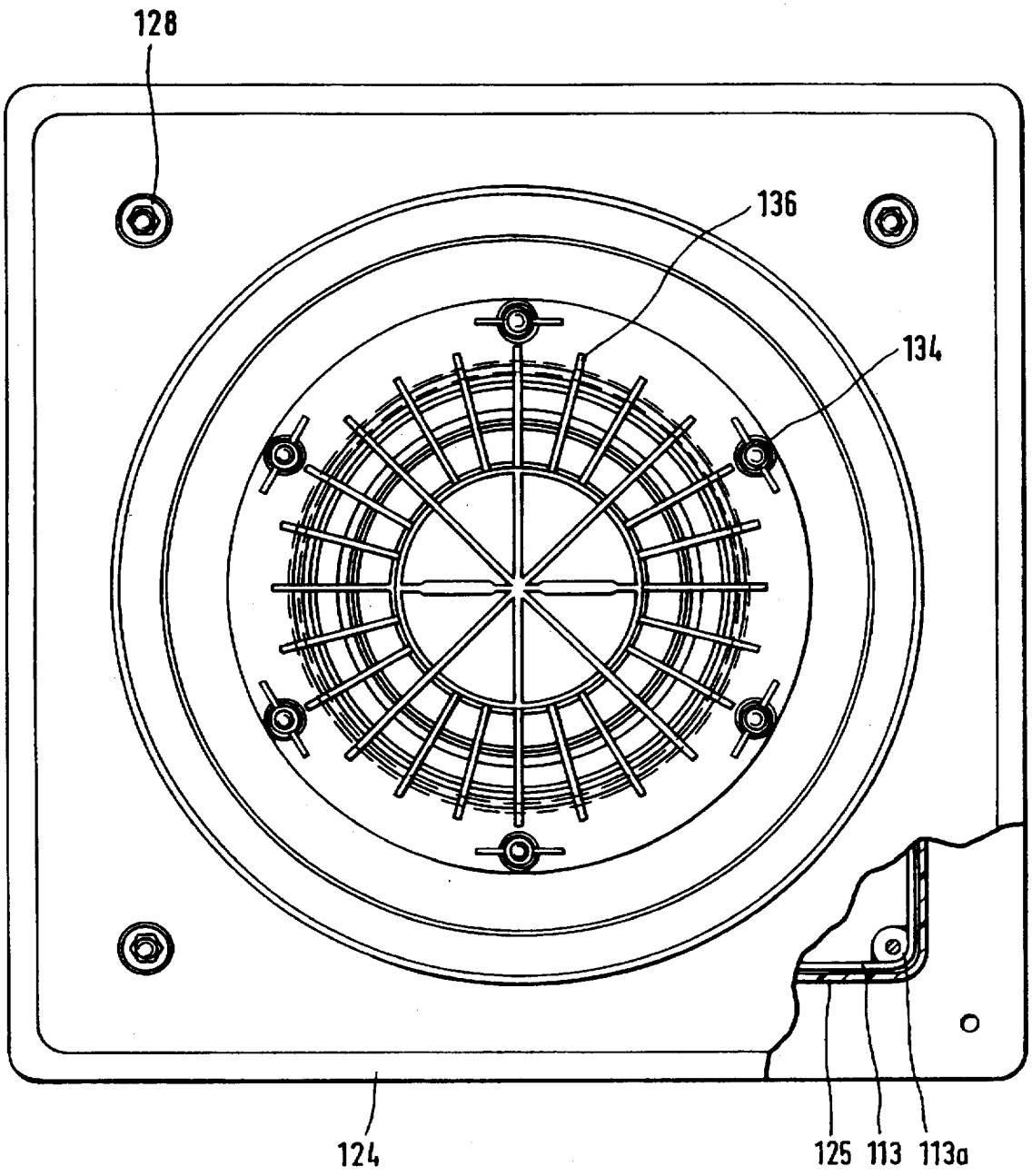
FIG. 11 is a top plan view of a complete roof drain fitting according to FIG. 8.

A top part or inlet part 120 is an integrally-molded part made of plastic including a down pipe 121, a pot-like pipe widening 122, and a collar 124 extending outwardly from the pot. Collar 124 is also square when viewed from the top, as shown in FIG. 11. Four planar walls 125 extend downwardly from collar 124. Walls 125 have reinforcements 125*a* in the corners, corresponding to reinforcements 113*a* of the bottom part, for receiving the plaster screws.

Several, preferably six, circular receiving elements 123 are molded on pot-like pipe widening 122, having through-extending bores 123*a* for receiving screws. These receiving elements 123 and bores 123*a* are for mounting a clamping ring 132. The majority of down pipe 121 and pipe expansion 122 is surrounded by cylindrical pipe insulation 127. FIG. 8 shows a molded part 114 for heat insulation inserted within bottom part 110 on the inside parallel with the box walls 113. Molded part 114 is square in plan view, and includes a circular opening for accommodating pipe insulation 127 of top part 120.

Figure 9:
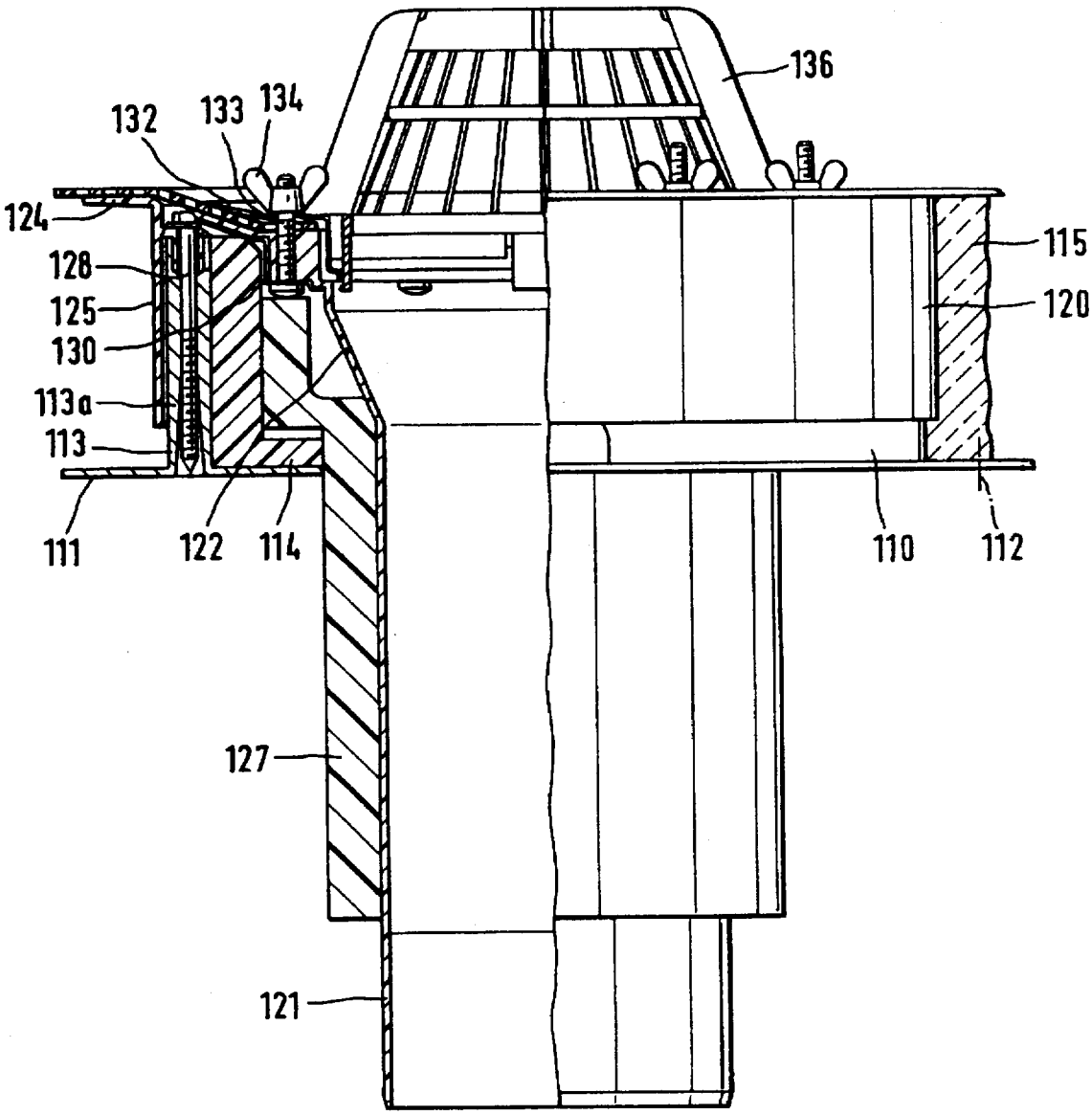
FIG. 9 is a longitudinal cross-sectional view through a completely installed roof drain fitting according to FIG. 8, with a minimum vertical adjustment of the orifice.

With the completely installed roof drain fitting shown in FIG. 9, bottom 111 of bottom part 110 is placed on a supporting roof, where a circular breakthrough is formed through the roof. Bottom part 110 is fastened on the roof by screws, which pass through screw holes 112. Top part 120 is coaxially slipped over bottom part 110 as shown. A circular recess 116 within bottom 111 receives down pipe 121 with pipe insulation 127. Top part 120 is slipped over bottom part 110 so that upper walls 125 come to rest on the outside next to box walls 113 of the bottom part. Plaster screws 128 in the corner zones vertically position top part 120 based on the thickness of heat insulation layer 115 resting on the roof.

Figure 10:
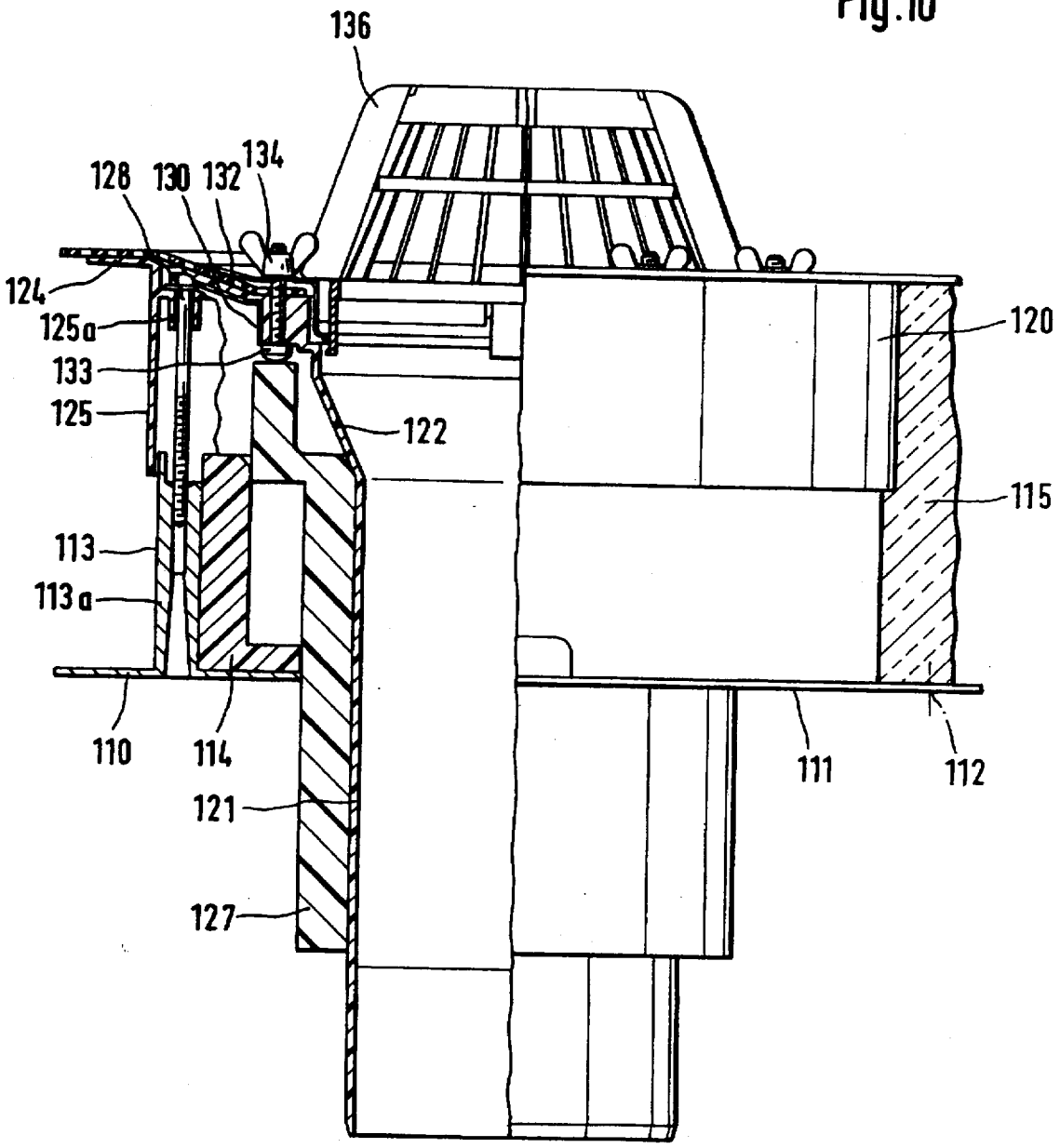
FIG. 10 is another longitudinal cross-sectional view with a maximum vertical adjustment.

A sealing web is placed on collar 124 with an optional sealing ring (not shown) in between. The sealing web is clamped tight by a clamping ring 132 with oval-head screws 133 extending through bores 123*a* and tightened by wing nuts 134, which at the same time engage a profiled support ring 130 which is adapted to the shape of the elements. In connection with FIG. 9, the spacing between bottom 111 and collar 124 is minimally adjusted by the plaster screws in view of a small thickness of heat insulation layer 115, whereby a maximum vertical adjustment is shown in FIG. 10. A basket 136 for collecting leaves in inserted in the clamping ring.

Accordingly, while only several embodiments of the present invention have been shown and described, it is obvious that many changes and modifications may be made thereunto without departing from the spirit and scope of the invention.

What is claimed is:

1. A roof drain fitting having a clamping ring for securing flashing to a supporting collar comprising:

a box-shaped bottom part including a bottom plate with a circular recess formed therein and planar side walls connected to said bottom plate, each side wall having an exterior surface;

a molded top part including a down pipe, a pot adjoining said down pipe, a collar extending outwardly from above said pot, and four planar walls extending downwardly from said collar, said down pipe, pot, collar, and walls being integrally molded in one piece; and means for adjustably securing said top part to said bottom part in different vertical positions without changing or removing any components of the fitting;

said down pipe extending through the circular recess to concentrically orient said top part with said bottom part with said four planar walls disposed adjacent said exterior surfaces of said side walls, wherein said top part is vertically adjusted by said securing means to secure said top part in a particular vertical position.

2. The roof drain fitting according to claim 1, wherein said securing means comprises arresting elements for adjustably securing said side walls to said four planar walls.

3. The roof drain fitting according to claim 2, comprising:

a cylindrical heat-insulating layer surrounding said down pipe and said pot; and a heat-insulating portion molded to an inside of said side walls of said bottom part.

4. The roof drain fitting according to claim 2, comprising a ring formed on said top part attached to said collar, said ring including threaded holes for receiving clamping ring screws.

5. The roof drain fitting according to claim 2, comprising:

an upper indentation formed in each corner where said adjacent planar walls meet, each indentation accommodating an arresting element; and a lower indentation corresponding to each upper indentation, formed in said bottom part.

6. The roof drain fitting according to claim 2, wherein said arresting elements comprise:

a leaf spring with a pin connected to said top part; and a row of holes formed in said planar side walls for receiving said pin.

7. The roof drain fitting according to claim 1, wherein one of said planar side walls includes an opening serving as an emergency water drain prior to installation of said top part.

8. The roof drain fitting according to claim 1, wherein said securing means comprises plaster screws.

9. The roof drain fitting according to claim 8, comprising:

a cylindrical heat-insulating layer surrounding said down pipe and said pot; and a heat-insulating, molded part disposed parallel to and adjacent an inner side of said planar side walls.

10. The roof drain fitting according to claim 8, comprising:

a plurality of receiving elements molded onto said collar, each receiving element including a bore; and a plurality of oval head screws and wing nuts for extending through the bores for attaching the clamping ring to said collar.

11. The roof drain fitting according to claim 8, comprising:

an upper reinforcement formed in each corner where said adjacent planar walls meet, each upper reinforcement accommodating a plaster screw; and a lower reinforcement corresponding to each upper reinforcement, formed in said bottom part.

12. The roof drain fitting according to claim 10, comprising a profiled support ring, wherein said oval head screws engage said clamping ring and said profiled support ring.

* * * * *